US009156270B2

(12) United States Patent
Yamamoto

(10) Patent No.: US 9,156,270 B2
(45) **Date of Patent: *Oct. 13, 2015**

(54) LIQUID EJECTING DEVICE

(71) Applicant: Brother Kogyo Kabushiki Kaisha, Nagoya-shi, Aichi-ken (JP)

(72) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/203,495

(22) Filed: Mar. 10, 2014

(65) Prior Publication Data

US 2014/0267494 A1 Sep. 18, 2014

Related U.S. Application Data

(63) Continuation of application No. 13/689,610, filed on Nov. 29, 2012, now Pat. No. 8,708,482.

(30) Foreign Application Priority Data

Nov. 30, 2011 (JP) ..... 2011-262757

(51) Int. Cl.
*B41J 29/13* (2006.01)
*B41J 2/165* (2006.01)
(Continued)

(52) U.S. Cl.
CPC ..... *B41J 2/16544* (2013.01); *B41J 2/16585* (2013.01); *B41J 2/1752* (2013.01);
(Continued)

(58) Field of Classification Search
USPC ..... 347/108, 109, 2; 400/691; 346/145
See application file for complete search history.

(56) References Cited

U.S. PATENT DOCUMENTS 4,893,137 A * 1/1990 Ebinuma et al. ..... 346/134
5,757,399 A 5/1998 Murayama et al.
(Continued)

FOREIGN PATENT DOCUMENTS

EP 0271090 A2 6/1988
JP H06-035244 A 2/1994
(Continued)

OTHER PUBLICATIONS

European Patent Office, European Search Report for European Patent Application No. 12185578.7 (counterpart to co-pending U.S. Appl. No. 13/689,610), dated Mar. 21, 2013.
(Continued)

*Primary Examiner* — Henok Legesse
(74) *Attorney, Agent, or Firm* — Baker Botts L.L.P.

(57) ABSTRACT

A liquid ejecting head is accommodated in a first casing. A supporting section is accommodated in a second casing. The first casing is pivotally movable relative to the second casing about a predetermined axis. Pivotal movement allows the first casing to take a first position at which an ejection surface confronts the supporting section and a second position at which the ejection surface is farther away from the supporting section than at the first position. The predetermined axis is closer to a first side surface than to a second side surface, and extends in parallel with the first side surface. The second side surface is formed with: a first opening through which a first medium tray is inserted or removed; a second opening through which a first tank is inserted or removed; and a third opening through which a waste-liquid tank is inserted or removed.

19 Claims, 11 Drawing Sheets

(51) Int. Cl.

| | |
|---|---|
| ***B41J 11/00*** | (2006.01) |
| ***B41J 29/02*** | (2006.01) |
| ***B41J 29/38*** | (2006.01) |
| ***B41J 2/175*** | (2006.01) |
| ***B41J 13/10*** | (2006.01) |

(52) U.S. Cl.

CPC ..... *B41J 11/00* (2013.01); *B41J 13/103* (2013.01); *B41J 29/02* (2013.01); *B41J 29/13* (2013.01); *B41J 29/38* (2013.01)

(56) References Cited

U.S. PATENT DOCUMENTS

| | | | | |
|---|---|---|---|---|
| 6,039,431 | A * | 3/2000 | Yui et al. | 347/30 |
| 7,334,861 | B2 * | 2/2008 | Ha | 347/19 |
| 8,016,412 | B2 | 9/2011 | Kawai et al. | |
| 8,297,731 | B2 | 10/2012 | Ochiai et al. | |
| 8,708,482 | B2 * | 4/2014 | Yamamoto | 347/108 |
| 2002/0024578 | A1 | 2/2002 | Yamashita | |
| 2005/0264601 | A1 * | 12/2005 | Park | 347/33 |
| 2007/0024682 | A1 | 2/2007 | Inoue | |
| 2007/0097172 | A1 | 5/2007 | Umeda | |
| 2007/0139506 | A1 * | 6/2007 | Yonekawa | 347/108 |
| 2007/0188580 | A1 | 8/2007 | Silverbrook | |
| 2013/0135390 | A1 | 5/2013 | Yamamoto | |
| 2013/0135406 | A1 | 5/2013 | Yamamoto | |

FOREIGN PATENT DOCUMENTS

| | | | |
|---|---|---|---|
| JP | 2003-103769 | A | 4/2003 |
| JP | 2004-306340 | A | 11/2004 |
| JP | 2005-088209 | A | 4/2005 |
| JP | 2008-230136 | A | 10/2008 |
| JP | 2010-260261 | A | 11/2010 |

OTHER PUBLICATIONS

United States Patent and Trademark Office, Office Action issued for co-pending U.S. Appl. No. 14/516,534, mailed Apr. 3, 2015.

* cited by examiner

LIQUID EJECTING DEVICE

CROSS REFERENCE TO RELATED APPLICATIONS

This application is a continuation of U.S. patent application Ser. No. 13/689,610 filed on Nov. 29, 2012, which claims priority from Japanese Patent Application No. 2011-262757 filed on Nov. 30, 2011, the disclosures of which are incorporated herein by reference in their entirety.

TECHNICAL HELD

The invention relates to a liquid ejecting device that ejects liquid from ejection ports.

BACKGROUND

A recording device is disclosed with which inserting and removing operations of a paper feed cassette, ink cartridges, and a waste-liquid collecting tank can be performed from one surface of an apparatus casing. That is, with this device, during inserting and removing operations of the paper feed cassette, the ink cartridges, and the waste-liquid collecting tank, portions accessed by a user are gathered on one surface.

SUMMARY

However, in the above-mentioned recording device, for example, it is not disclosed from which side of the device a jam process for recovering a jam (jamming of a recording medium) is to be performed. In recent years, there is a demand that a user wishes to perform multiple operations (the above-mentioned inserting and removing operations and jam process) from one surface side.

In view of the foregoing, it is an object of the invention to provide a liquid ejecting device that allows a user to access multiple operations from one surface side.

In order to attain the above and other objects, the invention provides a liquid ejecting device. The liquid ejecting device includes an apparatus casing, a liquid ejecting head, and a supporting section. The apparatus casing includes a first casing and a second casing. The apparatus casing has a first side surface and a second side surface opposite from the first side surface. The liquid ejecting head has an ejection surface that is formed with ejection ports for ejecting liquid. The liquid ejecting head is accommodated in the first casing. The supporting section is disposed in confrontation with the ejection surface and is configured to support a recording medium. The supporting section is accommodated in the second casing. The first casing is pivotally movable relative to the second casing about a predetermined axis. Pivotal movement of the first casing allows the first casing to take a first position at which the ejection surface confronts the supporting section and a second position at which the ejection surface is farther away from the supporting section than at the first position. The predetermined axis is located at a position closer to the first side surface than to the second side surface, and extends in a direction in parallel with the first side surface. The second side surface is formed with: a first opening through which a first medium tray configured to accommodate a recording medium is inserted or removed; a second opening through which a first tank configured to store liquid supplied to the liquid ejecting head is inserted or removed; and a third opening through which a waste-liquid tank configured to store liquid ejected from the liquid ejecting head is inserted or removed.

BRIEF DESCRIPTION OF THE DRAWINGS

Embodiments in accordance with the invention will be described in detail with reference to the following figures wherein.

DETAILED DESCRIPTION

The schematic configuration of an inkjet-type printer 101 according to an embodiment of the invention will be described while referring to FIGS. 1 through 4.

Figure 1:
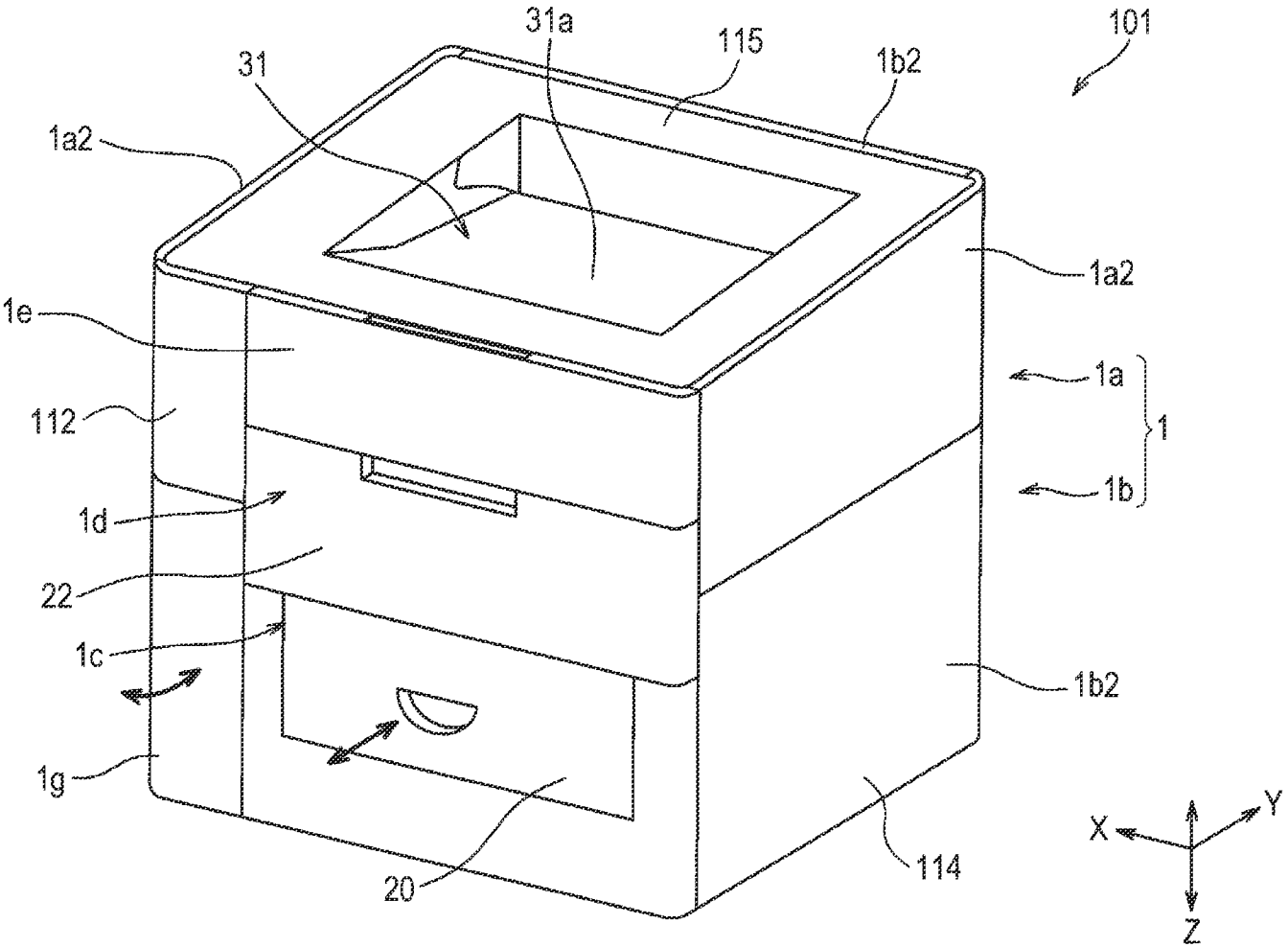
FIG. 1 is a perspective view showing the appearance of an inkjet-type printer according to an embodiment of the invention.

The printer 101 has an apparatus casing 1 including an upper casing 1*a* (first casing) and a lower casing 1*b* (second casing) both of which have a rectangular-parallelepiped shape and that have approximately the same size. The apparatus casing 1 is a rectangular-parallelepiped shape having six surfaces. The apparatus casing 1 has four side surfaces extending in a vertical direction Z. Of the four side surfaces, the side surface at the far side in a direction perpendicular to the drawing sheet of FIG. 1 is a rear surface 111 (first side surface (see FIG. 3)), and the side surface at the near side in the direction perpendicular to the drawing sheet of FIG. 1 is a front surface 112 (second side surface). Of the surfaces connecting the rear surface 111 and the front surface 112, the side surface at the far side in a direction perpendicular to the drawing sheet of FIG. 1 is a left surface 113, and the side surface at the near side in the direction perpendicular to the drawing sheet of FIG. 1 is a right surface 114. Of the surfaces connecting the rear surface 111 and the front surface 112, the surface at the upper side in the vertical direction Z is an upper surface 115. Each of the rear surface 111 and the front surface 112 extends in the vertical direction Z and in a main scanning direction X. Each of the right surface 114 and the left surface 113 extends in the vertical direction Z and in a sub-scanning direction Y. The upper surface 115 extends in the main scanning direction X and in the sub-scanning direction Y. The upper casing 1*a* has an opening at its lower side, and the lower casing 1*b* has an opening at its upper side. When the upper casing 1*a* lies on the lower casing 1*b* and the both openings are closed by each other, a space inside the printer 101 is defined (see FIG. 3). Here, the main scanning direction X is a direction in which an ejection surface 10*a* of a head 10 described later extends. The sub-scanning direction Y is a direction perpendicular to both the main scanning direction X and the vertical direction Z, and is a direction in which paper P is conveyed at a position facing the ejection surface 10*a*.

A paper discharging section 31 (first discharging section) is provided at the upper surface 115 of the apparatus casing 1. As indicated by thick dashed arrows in FIG. 3, a conveying path along which paper P is conveyed is formed in a space defined by the upper casing 1*a* and the lower casing 1*b* (an internal space of the apparatus casing 1) from a first paper feeding section 1*c* and a second paper feeding section 1*d* to the paper discharging section 31.

Figure 4:
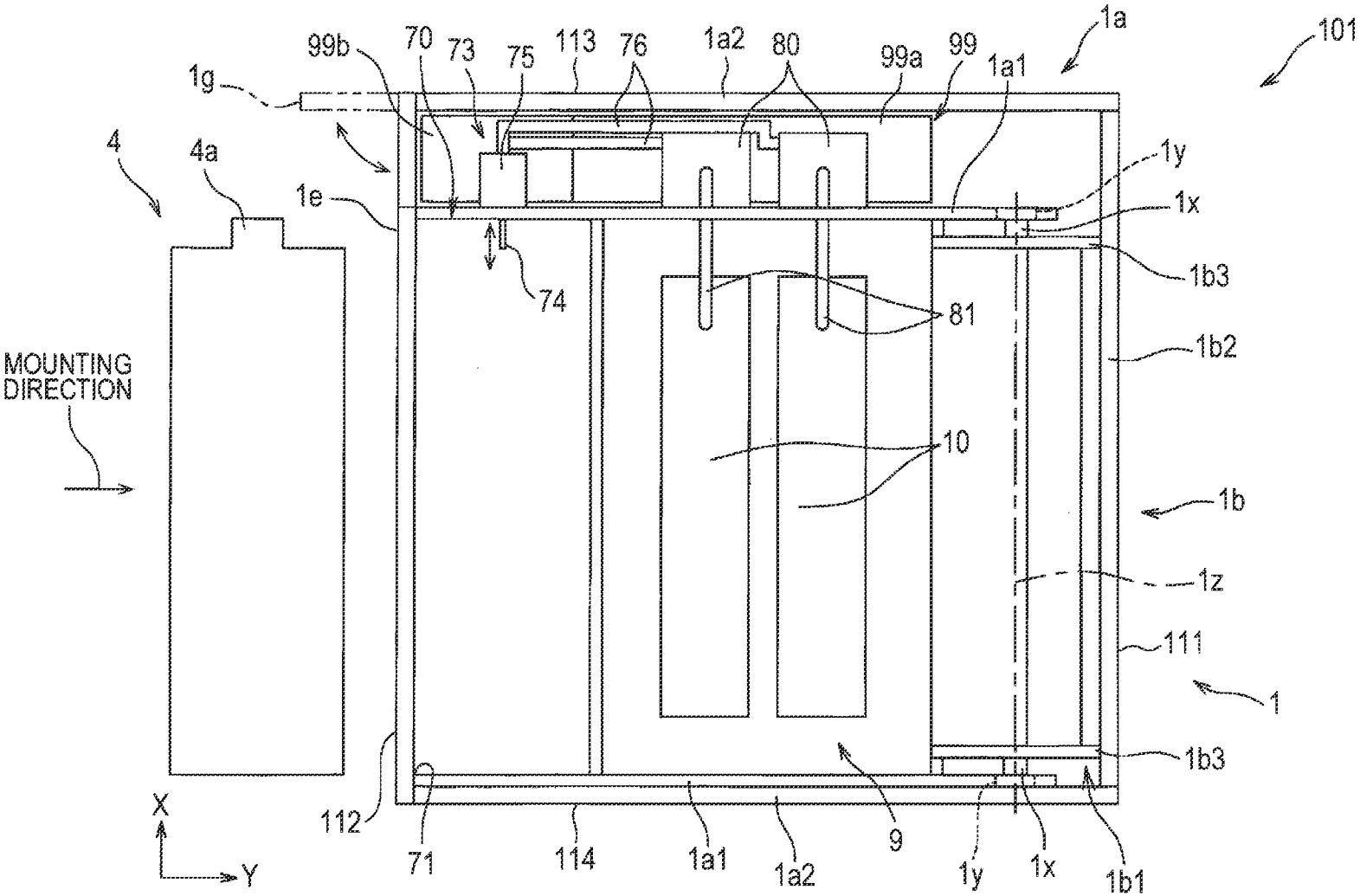
FIG. 4 is a schematic plan view showing the interior of the printer.

The upper casing 1*a* includes frames 1*a*1 (see FIG. 4) and panels 1*a*2 arranged outside the frames 1*a*1. The frames 1*a*1 include a pair of rigid frames confronting in the main scanning direction X and having high strength and a linking frame (not shown) that links the rigid frames. The lower casing 1*b* includes frames 1*b*1 (see FIGS. 2 and 4) and panels 1*b*2 arranged outside the frames 1*b*1. The frames 1*b*1 also include a pair of rigid frames confronting in the main scanning direction X and having high strength and a linking frame that links the rigid frames. As shown in FIGS. 5A and 5C, the pair of rigid, frames of the frames 1*b*1 has an L-shape as viewed from the main scanning direction X. The pair of rigid frames has a pair of protruding sections 1*b*3 that protrudes upward from its rear side in the sub-scanning direction Y. That is, each of the rigid frames has the protruding section 1*b*3 that protrudes upward from its rear surface 111 side. The frames 1*b*1 support a conveying mechanism 40 described later, and has the highest rigidity of all the frames. Note that, in FIG. 5C, the frame 1*a*1 of the upper casing 1*a* and the frame 1*b*1 of the lower casing 1*b* are shown in bold lines for illustration purposes.

The apparatus casing 1 has a shaft 1*x* extending in the main scanning direction X. As shown in FIG. 3, the shaft 1*x* is located near one end (the right end in FIG. 3) of the upper casing 1*a* in the sub-scanning direction Y and at approximately a center of the upper casing 1*a* in the vertical direction Z. That is, the shaft 1*x* is disposed at a position closer to the rear surface 111 of the apparatus casing 1 than to the front surface 112 of the apparatus casing 1. The upper casing 1*a* is linked to the lower casing 1*b* via the shaft 1*x*. The upper casing 1*a* can be pivotally moved, about an axis 1*z* of the shaft 1*x*, relative to the lower casing 1*b*. With pivotal movement, the upper casing 1*a* can take both an adjacent position at which the upper casing 1*a* is adjacent to the lower casing 1*b* (first position: the position shown in FIGS. 1 and 3) and a spaced position at which the upper casing 1*a* is farther spaced away from the lower casing 1*b* than at the adjacent position (second position: the position shown in FIG. 2). At the spaced position, a distance between an ejection surface 10*a* of a head 10 described later and platens 44 and 45 is larger than the corresponding distance at the adjacent position. When the upper casing 1*a* is at the spaced position, a part of the paper conveying path (especially, the part between the ejection surface 10*a* and the platens 44, 45) formed by the upper casing 1*a* and the lower casing 1*b* at the adjacent position is exposed to the outside, and a work space for a user is secured on the paper conveying path. The user can use the work space to manually perform a jam process (an operation of removing a jam of paper P on the conveying path) from the front surface 112 of the apparatus casing 1. That is, a jam process can be performed from the front surface 112 side. That is, "front access" becomes possible.

The shaft 1*x* is formed to protrude outward in the main scanning direction X at each of the pair of protruding sections 1*b*3 (see FIGS. 4, 5A, and 5C) that protrudes upward in the frames 1*b*1 of the lower easing 1*b*. The shaft 1*x* extends in the main scanning direction X, and its axial direction (the direction in which the axis 1*z* extends) is in parallel with the main scanning direction X (a horizontal direction). As shown in FIG. 4, bearings 1*y* for rotatably supporting the shaft 1*x* are provided at the frames 1*a*1 of the upper casing 1*a*. The upper casing 1*a* and the lower casing 1*b* are pivotally coupled by the shaft 1*x* and the bearings 1*y*.

The shaft 1*x* is provided with a spring (not shown) that urges the upper casing 1*a* in such a direction that the upper casing 1*a* is opened (from the adjacent position toward the spaced position). In the present embodiment, the upper casing 1*a* can open up to a predetermined angle with respect to a horizontal surface. That is, the upper casing 1*a* can open until an angle θ made by the upper casing 1*a* and the lower casing 1*b* reaches the predetermined angle. The predetermined angle is such an angle that the user can put his or her hand between the upper casing 1*a* and the lower casing 1*b* for a jam process, and is 29° (degrees) in the present embodiment.

Figure 2:
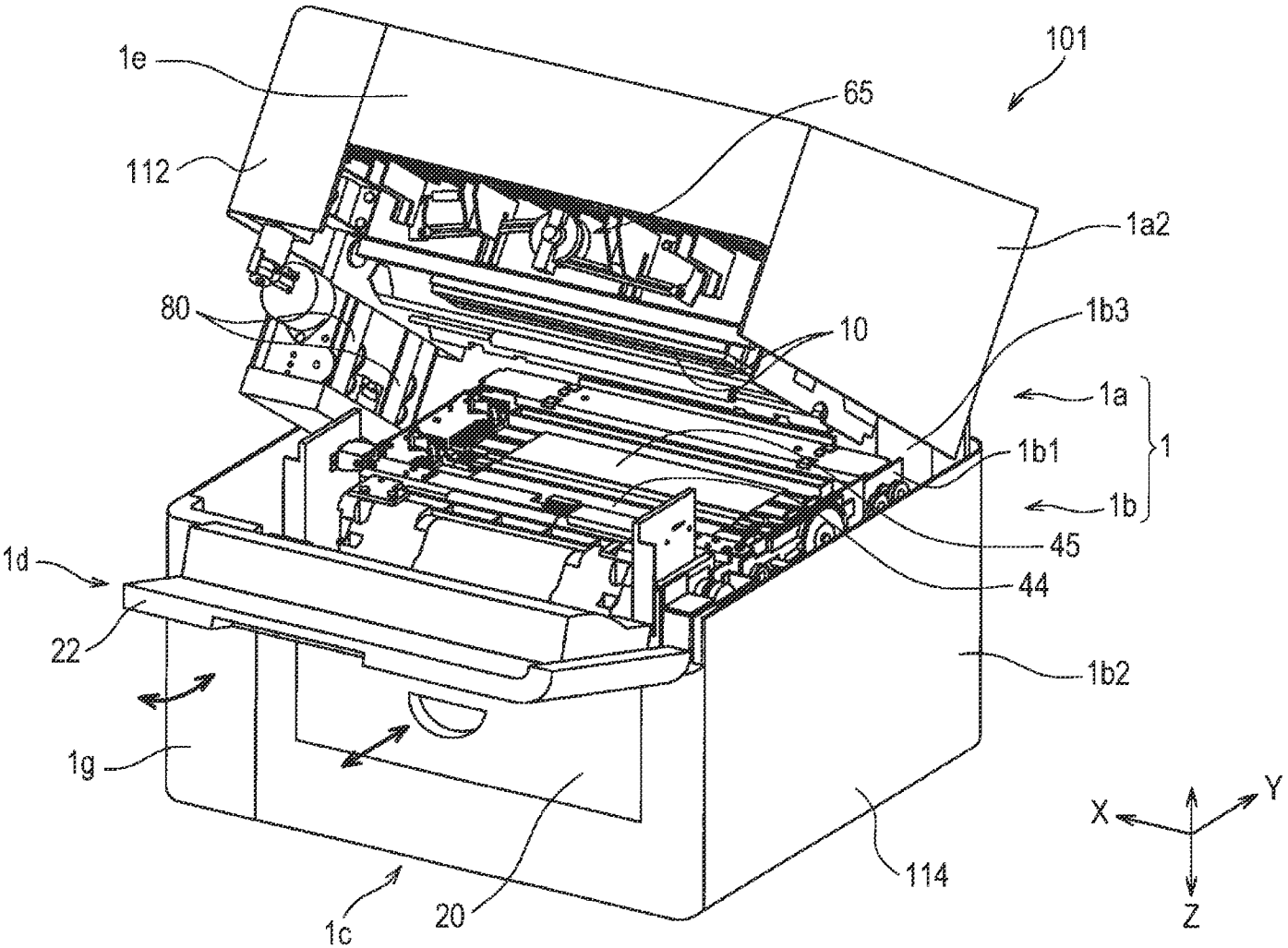
FIG. 2 is a perspective view showing the appearance of the printer in a state where an upper casing of the printer is pivotally moved relative to a lower casing and is disposed in a spaced position.
Figure 3:
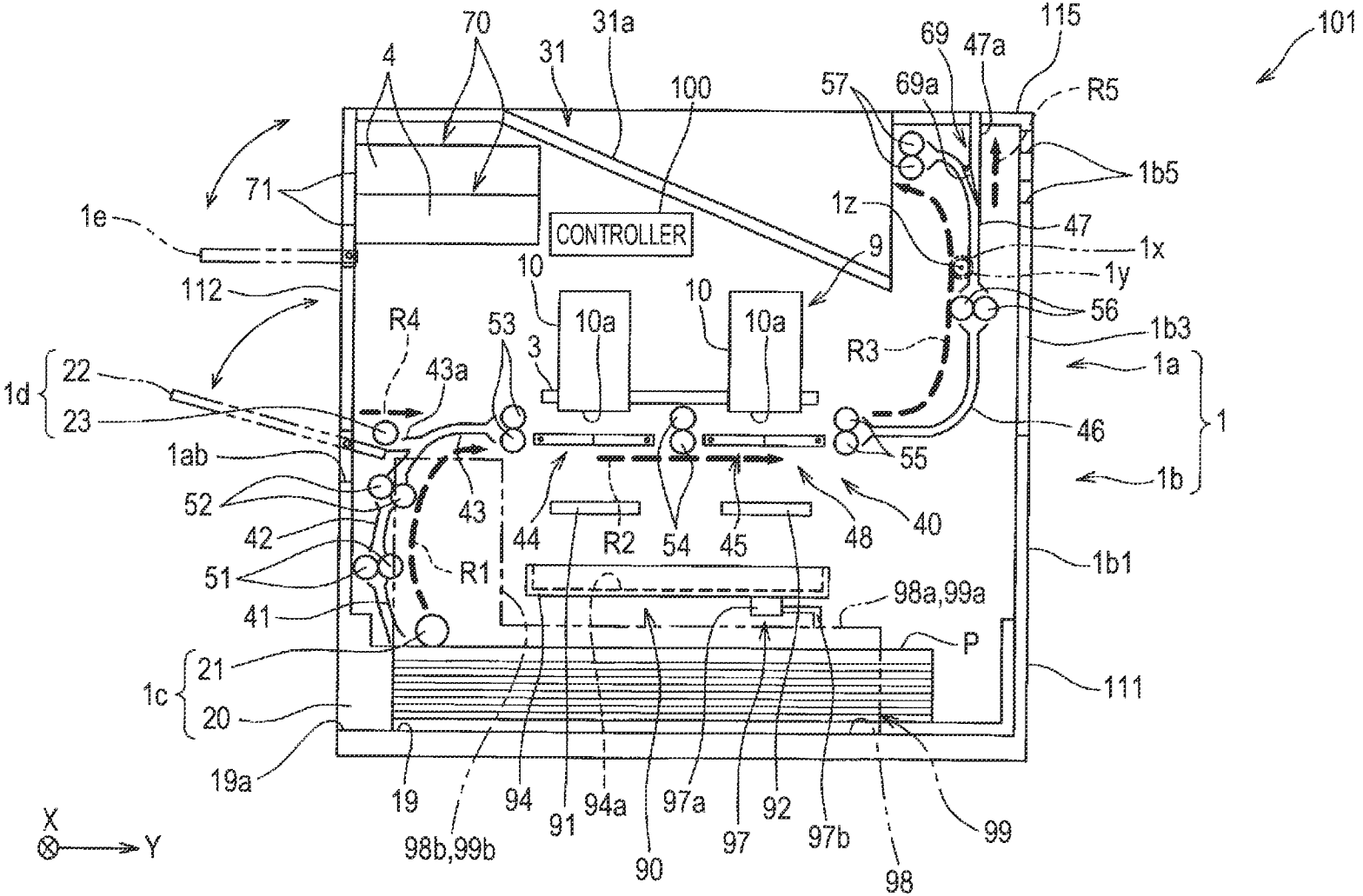
FIG. 3 is a schematic side view showing the interior of the printer.

As shown in FIG. 2, a lock mechanism 65 is provided at the front surface of the upper casing 1*a* for restricting movement of the upper casing 1*a* located at the adjacent position. A door 22 straddling the upper and lower casings 1*a* and 1*b* and capable of opening and closing is provided at the front surface 112 of the apparatus casing 1. The door 22 is configured to partially cover the front surface 112 of the apparatus casing 1 in a closed state. By opening the door 22, the lock mechanism 65 is exposed. By releasing restriction performed by the lock mechanism 65, the upper casing 1*a* can be pivotally moved relative to the lower casing 1*b*. Further, when the upper casing 1*a* at the spaced position is returned to the adjacent position, the lock mechanism 65 automatically restricts movement of the upper casing 1*a*. Note that the door 22 also functions as a manual-feed tray 22 (second medium tray) of the second paper feeding section 1*d* as will be described later. The manual-feed tray 22 is disposed between a mount opening 19*a* and a mount opening 71 (the both to be described later) with respect to the vertical direction Z.

Next, various elements arranged in the internal space of the printer 101 will be described while referring to FIGS. 3 through 5C etc.

Figure 7:
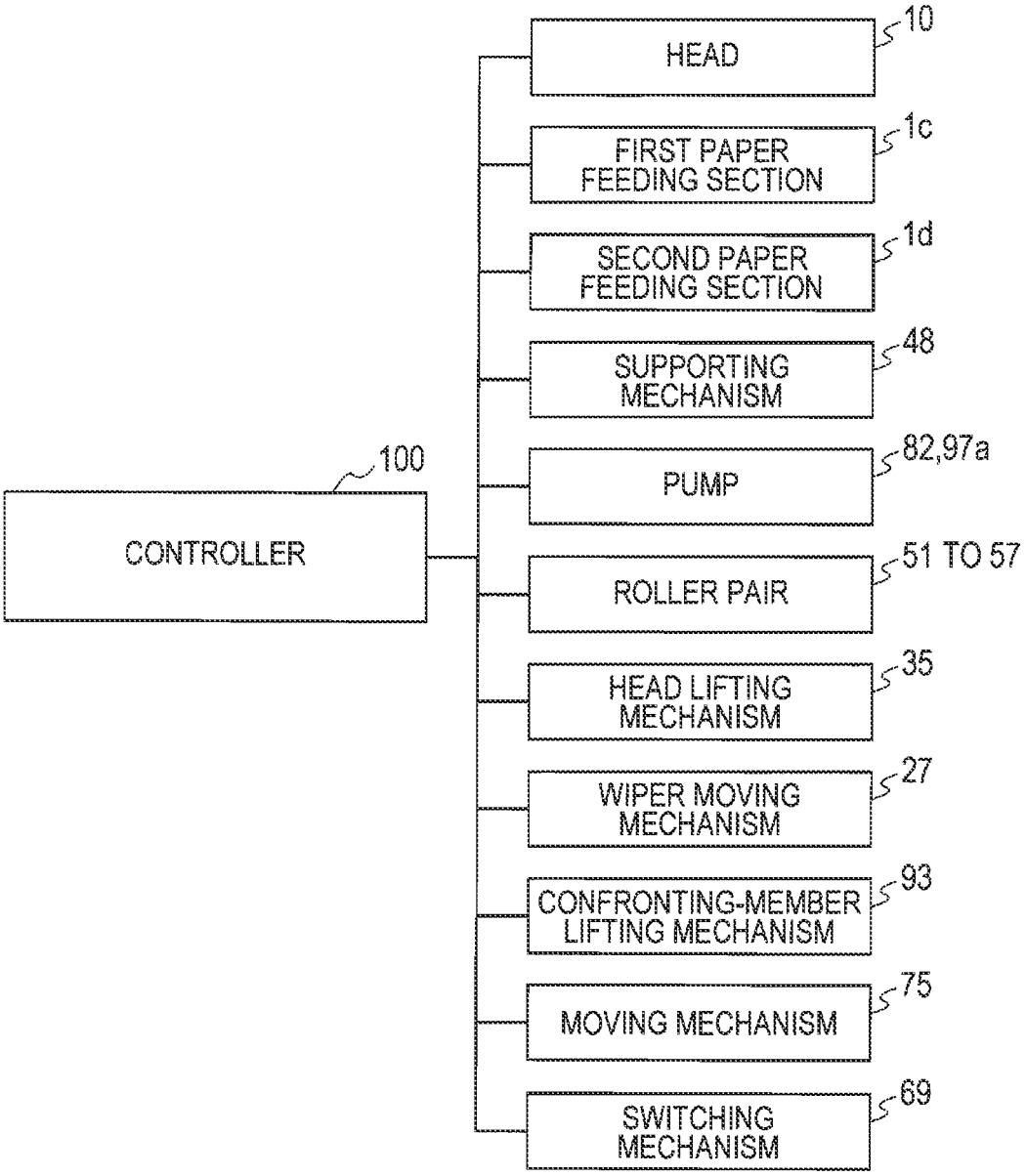
FIG. 7 is a block diagram showing a configuration for controlling the printer shown in FIG. 1.
Figure 8A:
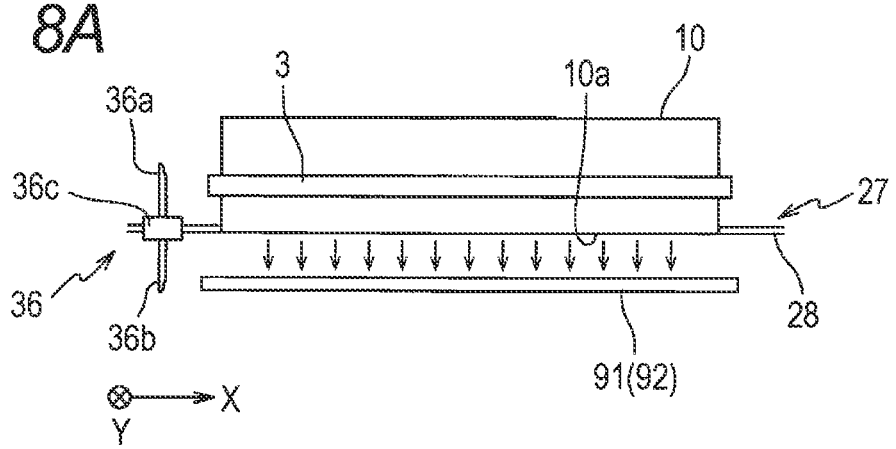
FIGS. 8A through 8C are schematic views for illustrating first and second wiping operations.
Figure 8B:
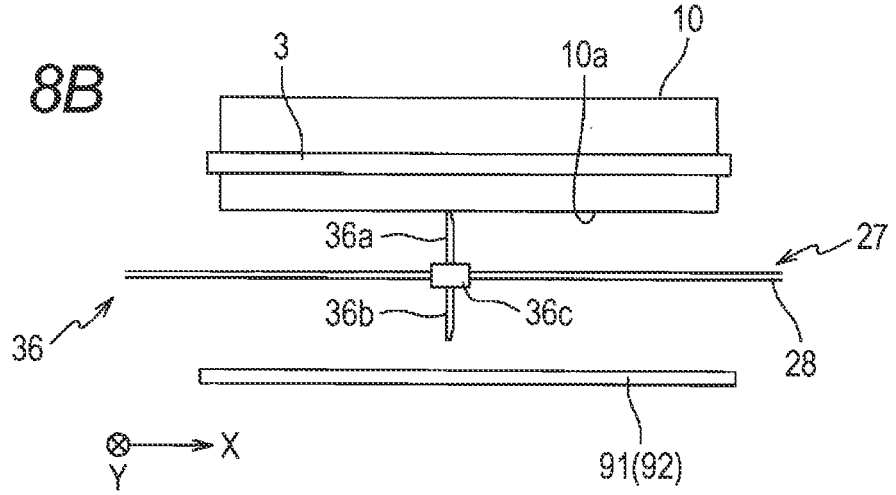
Figure 8C:
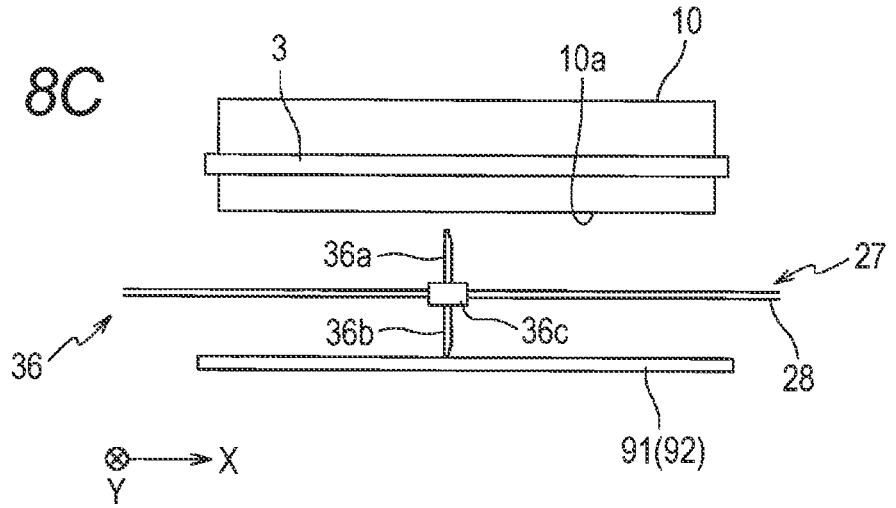

As shown in FIG. 3, the apparatus casing 1 accommodates, in its internal space, a controller 100 that controls various sections of the printer 101, the conveying mechanism 40 that defines the conveying path of paper P, a head unit 9, a head lifting mechanism 35 (see FIG. 7), two subsidiary tanks 80 (second tank) (see FIG. 2), two cartridges 4 (first tank), two cartridge mount sections 70, the first paper feeding section 1*c*, the second paper feeding section 1*d*, a liquid receiving section 90, a waste-liquid tank 99, a waste-liquid-tank mount section 98, a waste-liquid conveying section 97, and a wiper unit 36 (see FIGS. 8A through 8C). Of these, the controller 100, the head unit 9, the head lifting mechanism 35, the two subsidiary tanks 80, the two cartridges 4, and the cartridge mount sections 70 are provided at the upper casing 1*a*. The conveying mechanism 40, the first paper feeding section 1*c*, the second paper feeding section 1*d*, the liquid receiving section 90, the waste-liquid tank 99, the waste-liquid-tank mount section 98, the waste-liquid conveying section 97, and the wiper unit 36 are provided at the lower casing 1*b*.

The conveying path defined by the conveying mechanism 40 includes paths R1, R2, and R3 used for normal conveying, a path R4 connecting the second paper feeding section 1*d* with the path R1, and a path R5 connected with a paper discharge tray 200 (see FIG. 10) described later when the paper discharge tray 200 is additionally mounted on the printer 101. The conveying mechanism 40 includes elements defining the path R1 through R5 to be described later and a conveying motor (not shown). The conveying mechanism 40 is supported by the frames 1*b*1. The elements defining the paths R3 and R5 are supported by the pair of protruding sections 1*b*3 of the frames 1*b*1.

The path R1 is a path that is curved in a U-shape as viewed from the main scanning direction X and that leads from the first paper feeding section 1*c* to a recording position. The path R1 is defined by guides 41 through 43 and roller pairs 51 through 53. Here, the recording position is a position confronting the ejection surface 10*a*, and is a position between each ejection surface 10*a* and the counterpart platen 44, 45. The path R1 is a path for conveying paper P accommodated in a paper feed tray 20 from the rear surface 111 side to the front surface 112 side and subsequently conveying the paper P to the rear surface 111 side in a U-turn at the front surface 112 side of the apparatus casing 1.

Figure 6A:
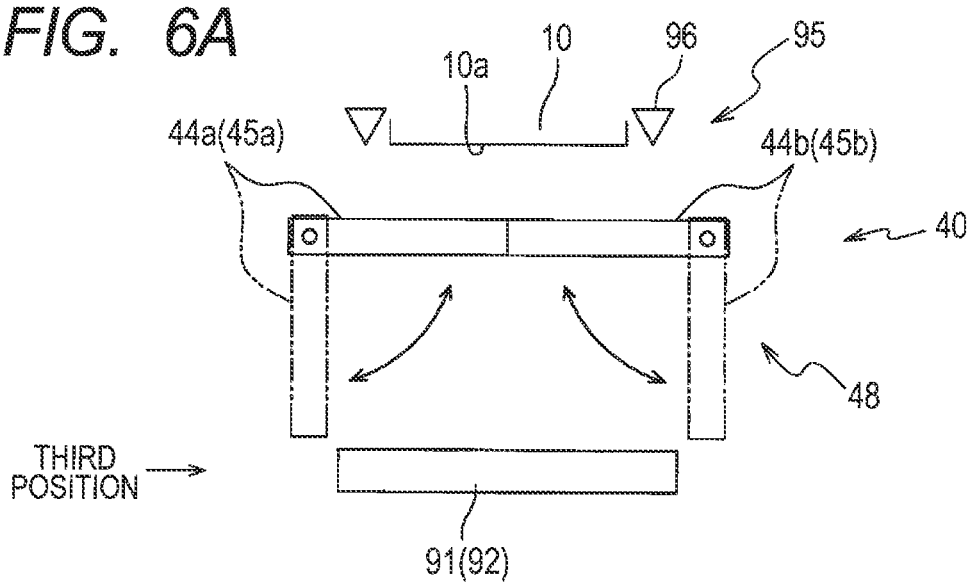
FIGS. 6A through 6C are schematic views for illustrating operations of a supporting mechanism and a confronting member.
Figure 6B:
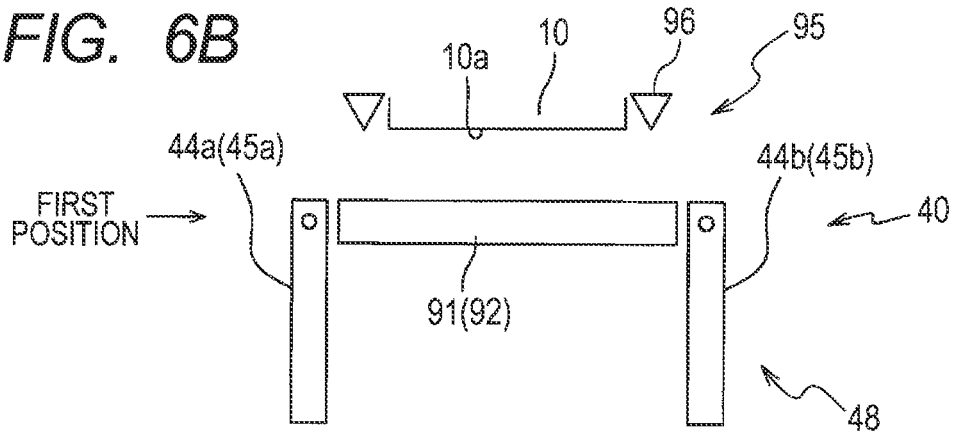

The path R2 is a path that passes through respective recording positions of the two heads 10, and that is defined by the platens 44 and 45 (supporting section) in confrontation with the respective ejection surfaces 10*a* of the two heads 10 and by a pair of rollers 54. The path R2 is a path for conveying paper P from the front surface 112 side toward the rear surface 111 side. A supporting mechanism 48 includes the platens 44 and 45. The supporting mechanism 48 supports, from the underside, paper P that is conveyed during recording. The platen 44 has divided platens 44*a* and 44*b* that are divided into two pieces. Similarly, the platen 45 has divided platens 45*a* and 45*b* that are divided into two pieces. The supporting mechanism 48 has a driving motor (not shown) for pivotally moving each of the divided platens 44*a*, 44*b*, 45*a*, and 45*b*. Each of the divided platens 44*a*, 44*b*, 45*a*, and 45*b* has a pivotal axis extending in the main scanning direction X. Each of the divided platens 44*a* and 45*a* at the upstream side in the conveying direction has a pivotal center at their upstream ends in the conveying direction. Each of the divided platens 44*b* and 45*b* at the downstream side in the conveying direction has a pivotal center at their downstream ends in the conveying direction. Here, the conveying direction is a direction in which paper P is conveyed along the path R2. The controller 100 controls the driving motor to drive each of the platens 44 and 45 (the divided platens 44*a*, 44*b*, 45*a*, and 45*b*) to pivotally move between a supporting-surface forming position and an open position. At the supporting-surface forming position, as shown in FIGS. 3 and 6A, the free ends of the divided platens 44*a* and 44*b* abut each other, and the divided platens 44*a* and 44*b* form a planar supporting surface. Similarly, at the supporting-surface forming position, the free ends of the divided platens 45*a* and 45*b* abut each other, and the divided platens 45*a* and 45*b* form a planar supporting surface. At the open position, as shown in FIG. 6B, each of the divided platens 44*a*, 44*b*, 45*a*, and 45*b* is pivotally moved 90 degrees, and each free end hangs down. And, the upper surfaces of the divided platens 44*a* and 44*b* confront each other. Similarly, the upper surfaces of the divided platens 45*a* and 45*b* confront each other. Thus, the ejection surfaces 10*a* directly confront confronting members 91 and 92. When the platens 44 and 45 are at the open position, the confronting members 91 and 92 can move upward and downward. Note that the two platens 44 and 45 are located at the supporting-surface forming position during a recording operation, and are located at the open position during a maintenance operation.

The path R3 is a path that is curved in a U-shape, as viewed from the main scanning direction X, leading from the recording position to the paper discharging section 31, and that is defined by guides 46 and 47 and pairs of rollers 55 through 57. The path R3 is a path for conveying paper P having passed through the path R2 from the front surface 112 side to the rear surface 111 side and subsequently conveying the paper P to the front surface 112 side in a U-turn at the rear surface 111 side of the apparatus casing 1. The path R3 is located farther upward than the recording position, and is curved in the opposite direction from the path R1. That is, as shown in FIG. 3, the path R1 is curved to be convex toward the front surface 112 side (the left side in FIG. 3) near the front surface 112, whereas the path R3 is curved to be convex toward the rear surface 111 side (the right side in FIG. 3) near the rear surface 111. Thus, when viewed in a direction perpendicular to the drawing sheet of FIG. 3 (toward the far side), the paths R1 through R3 are formed in a reversed S-shape, as a whole.

The path (conveying path) R4 is a path leading from the second paper feeding section 1*d* to a middle part of the path R1, and is defined by a divergence guide 43*a* diverged from the guide 43. The path R5 is a path leading upward in the vertical direction Z from a middle part of the path R3, and is defined by a divergence guide 47*a* diverged from the guide 47. Each of the roller pairs 51 through 57 includes a drive roller that is connected with a conveying motor and a follow roller that rotates following rotation of the drive roller.

A switching mechanism 69 for switching the conveying path of paper P is provided at connection between the path R3 and the path R5. The switching mechanism 69 includes a swing member 69*a* and a driving section (not shown) for driving the swing member 69*a*. The swing member 69*a* swings between a first position for blocking the path R5 (the position shown in FIG. 3) and a second position for allowing passage between the path R3 and the path R5 (the position shown in FIG. 10). The controller 100 controls the driving section to drive the switching mechanism 69, such that the swing member 69*a* is disposed at the first position when paper P is discharged to the paper discharging section 31 and that the swing member 69*a* is disposed at the second position when paper P is discharged to the paper discharge tray 200.

As shown in FIG. 3, the paper discharging section 31 is provided at the upper surface 115 of the upper casing 1*a*. The paper discharging section 31 has a supporting surface 31*a* that supports discharged paper P. The supporting surface 31*a* is slanted downward toward the shaft 1*x* in the sub-scanning direction Y. Paper P discharged to the paper discharging section 31 slides downward along a slant of the supporting surface 31*a*, and the upstream end of the paper P in the conveying direction abuts a wall surface of the paper discharging section 31 at the upstream side in the conveying direction. Thus, paper P discharged to the paper discharging section 31 is aligned. Further, when paper P is discharged onto the paper discharging section 31, the end of the paper P at the front surface 112 side is located at a higher position than the end at the rear surface 111 side. Hence, paper P can be taken out from the front surface 112 side most easily. As a result, an operation of taking paper P can be accessed from the front surface 112 side. That is, "front access" becomes possible. Note that, because the supporting surface 31*a* is slanted, the size of the paper discharging section 31 in the sub-scanning direction Y can be reduced.

The end of the supporting surface 31*a* at the rear surface 111 side is located between the cartridge mount sections 70 and the ejection surfaces 10*a* with respect to the vertical direction Z. Further, a part of the supporting surface 31*a* at the front surface 112 side overlaps a part of the cartridge mount sections 70 at the rear surface 111 side in the vertical direction Z. With this configuration, with respect to the vertical direction Z, the cartridge mount sections 70 can be arranged in a dead space between the supporting surface 31*a* of the upper casing 1*a* and the heads 10. This contributes to downsizing of the printer 101. Supposedly, if the supporting surface 31*a* is slanted toward the opposite side (slanted such that the end of the supporting surface 31*a* at the upstream side in the conveying direction is located at a higher position than the end at the downstream side in the conveying direction), the cartridge mount section 70 is disposed at a lower position than the downstream end of the supporting surface 31*a* with respect to the vertical direction Z. Then, the height of the printer 101 increases. Or, if the cartridge mount section 70 does not overlap the supporting surface 31*a* in the vertical direction Z, the size of the printer 101 in a plan view increases.

The head unit 9 includes the two heads 10 and a carriage 3 that supports the heads 10. The two heads 10 include a precoat head that ejects pretreatment liquid and an inkjet head that ejects black ink, which are arranged in this order from the upstream side in the conveying direction of paper P.

Each head 10 has the same structure, and is a line-type head that is elongated in the main scanning direction X, and has an outer shape of substantially a rectangular-parallelepiped. The heads 10 are fixed to the carriage 3, while being spaced away from each other in the sub-scanning direction Y. The carriage 3 is supported by the frames 1*a*1 of the upper casing 1*a*, such that the carriage 3 can move up and down.

The lower surface of the head 10 serves as the ejection surface 10*a* in which a large number of ejection ports are formed. Liquid channels are formed within the head 10 for allowing pretreatment liquid or black ink (hereinafter, collectively referred to as "liquid") supplied from the cartridge 4 to flow to the ejection ports. Here, pretreatment liquid is a liquid having a function of preventing spread and strike-through of ink, a function of improving color production performance and quick-drying performance of ink, and the like. In FIG. 3, the ejection surface 10*a* is a surface in parallel with a horizontal surface.

The subsidiary tanks 80 are tanks that temporarily store liquid supplied from the respective cartridges 4. As shown in FIG. 4, the subsidiary tanks 80 are arranged to be aligned with the respective heads 10 in the main scanning direction X as viewed from the vertical direction Z, and are arranged at positions closer to the left surface 113 than the heads 10 are. The subsidiary tank 80 and the head 10 are arranged to partially overlap each other in the main scanning direction X (see FIGS. 5A and 5B). The subsidiary tanks 80 are arranged at one end side (the upper in FIG. 4) relative to the center of the upper casing 1*a*, in the main scanning direction X. The subsidiary tanks 80 are supported by the frame 1*a*1 between the frame 1*a*1 and the panel 1*a*2. The subsidiary tanks 80 are connected with the respective heads 10 via the pipes 81. As shown in FIG. 5A, the subsidiary tanks 80 are arranged at lower positions than the heads 10 with respect to the vertical direction Z. With this configuration, the liquid surface of liquid stored in the subsidiary tanks 80 is within a predetermined level range that is lower than the ejection surface 10*a*. Thus, pressure within the head 10 is maintained in a predetermined range of negative pressure, which prevents liquid from leaking from the ejection ports. The subsidiary tanks 80 are supported by the frame 1*a*1, such that the inner liquid surface is within the predetermined level range that is lower than the ejection surface 10*a* even when the upper casing 1*a* is at the spaced position. Hence, even if the upper casing 1*a* moves between the spaced position and the adjacent position, pressure within the head 10 is kept at negative pressure, thereby suppressing liquid from leaking from the ejection ports.

Each subsidiary tank 80 is provided with the pump 82 (see FIG. 7). The controller 100 controls each pump 82 to forcefully send liquid within the subsidiary tank 80 to the head 10.

As shown in FIGS. 3 and 4, the cartridge mount sections 70 (first tank mount section) are provided between the two frames 1*a*1 of the upper casing 1*a* in the main scanning direction X. The cartridge mount sections 70 are arranged at a higher position than the heads 10 and the subsidiary tanks 80 with respect to the vertical direction Z (see FIGS. 5A and 5B). With this configuration, liquid can be supplied naturally from the mounted cartridges 4 to the subsidiary tanks 80. Alternatively, liquid may be supplied from the mounted cartridges 4 to the subsidiary tanks 80 with a pump.

The cartridge mount sections 70 define spaces to which the respective cartridges 4 are mounted. As shown in FIG. 4, each cartridge mount section 70 extends to be elongated in the main scanning direction X, like the head 10. Further, the cartridge mount sections 70 (and the mounted cartridges 4) are arranged to be aligned with the heads 10 in the sub-scanning direction Y, as viewed from the vertical direction Z. The cartridge mount sections 70 are arranged at positions closer to the front surface 112 than the heads 10 are. Because the cartridge mount sections 70 are arranged in this configuration, although the heads 10 elongated in the main scanning direction X are adopted, the space within the upper casing 1*a* can be utilized effectively. Hence, the upper casing 1*a* can be downsized in the main scanning direction X, which suppresses an increase in the size of the printer 101 in a plan view (i.e., footprint).

Figure 9:
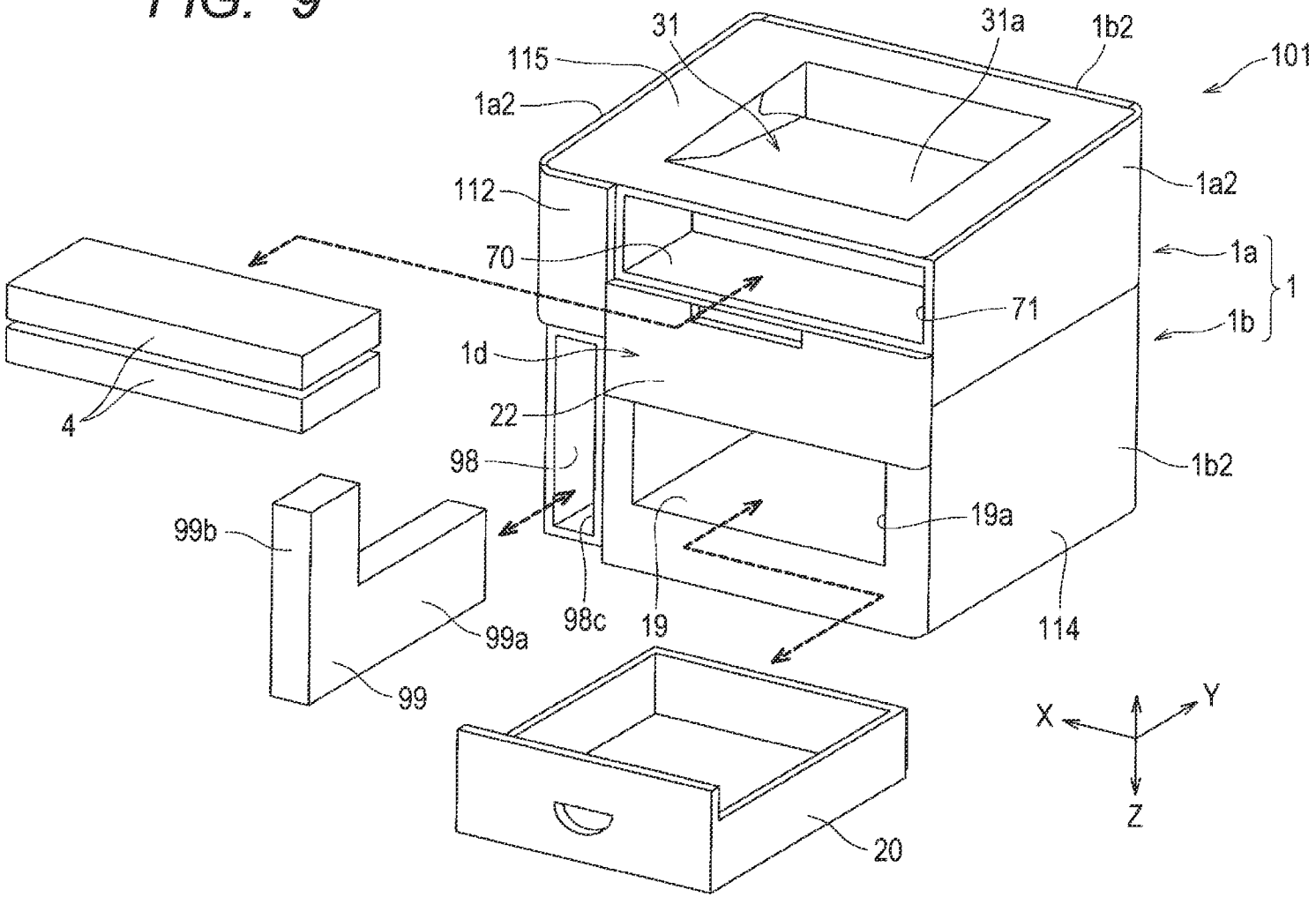
FIG. 9 is a perspective view showing the appearance of the printer for illustrating respective mount openings of a paper feed tray, cartridges, and a waste-liquid tank.

The mount opening 71 (second opening) of each cartridge mount section 70 is formed in the front surface 112 of the upper casing 1*a*. As shown in FIG. 9, the mount opening 71 is formed at a position on the front surface 112, the position being close to the upper surface 115 and the right surface 114. The mount opening 71 has generally a rectangular shape that is elongated in the main scanning direction X. The cartridge mount section 70 has a space having generally a rectangular-parallelepiped shape extending from the mount opening 71, and from the front surface 112 toward the rear surface 111. This space has a size and shape capable of accommodating the cartridge 4. A door 1*e* (see FIG. 1) for opening and closing the mount openings 71 is provided at the upper casing 1*a*. Note that the door 1*e* is omitted in FIG. 9 for simplicity. The door 1*e* is a plate-shaped member that is pivotally supported by the upper casing 1*a*. As indicated by the double-dot chain lines in FIG. 3, the mount openings 71 are exposed by pivotally moving the door 1*e*. Through the mount openings 71, the cartridges 4 are inserted into or removed from the cartridge mount sections 70. The cartridges 4 are mounted on the cartridge mount sections 70 by being inserted into the mount openings 71. By inserting and removing the cartridges 4, the cartridges 4 can be replaced. The inserting (mounting) direction of the cartridges 4 is a direction in parallel with the sub-scanning direction Y, and is a direction from the front surface 112 toward the rear surface 111.

As shown in FIG. 4, a liquid conveying section 73 is provided at one end side (the upper in FIG. 4) of the cartridge mount section 70 in the main scanning direction X. The liquid conveying section 73 includes a hollow needle 74, a moving mechanism 75 that moves the hollow needle 74, and pipes 76. The liquid conveying section 73 is provided for each of the cartridge mount sections 70. The pipe 76 connects the hollow needle 74 with the subsidiary tank 80. The upper liquid conveying section 73 is connected with the subsidiary tank 80 for the precoat head 10 which is located at an upstream side in the conveying direction. The lower liquid conveying section 73 is connected with the subsidiary tank 80 for the inkjet head 10.

The controller 100 controls the moving mechanism 75 to move the hollow needle 74 in the main scanning direction X between a connection position and a separation position. At the connection position, the hollow needle 74 protrudes into the cartridge mount section 70 so as to connect the cartridge 4 mounted on the cartridge mount section 70 with the liquid conveying section 73. At the separation position, the hollow needle 74 does not protrude into the cartridge mount section 70 so as to be separated from the cartridge 4 mounted on the cartridge mount section 70. Inserting and removing (mounting and dismounting) operations of the cartridge 4 are performed in a state where the hollow needle 74 is at the separation position. Further, the moving mechanism 75 is disposed to be aligned with the cartridge mount section 70 in the main scanning direction X, and is disposed at a position closer to the left surface 113 than the cartridge mount section 70 is. The moving mechanism 75 and the cartridge mount section 70 are arranged to partially overlap each other in the main scanning direction X.

As shown in FIG. 4, the cartridge 4 has substantially a rectangular-parallelepiped shape that is elongated in the main scanning direction X in a state where the cartridge 4 is mounted on the cartridge mount section 70. Liquid is filled inside the cartridge 4. A liquid supplying section 4*a* protruding in the main scanning direction X is provided at one end (the upper in FIG. 4) of the cartridge 4 in the main scanning direction X. A spout made of rubber is provided at a tip end surface of the liquid supplying section 4*a*. After the cartridge 4 is mounted on the cartridge mount section 70, the controller 100 controls the moving mechanism 75 to move the hollow needle 74 from the separation position to the connection position, so that the hollow needle 74 penetrates the spout. With this operation, liquid within the cartridge 4 is supplied to the subsidiary tank 80 through the hollow needle 74 and the pipe 76. The liquid supplying section 4*a* is located at the subsidiary tank 80 side, with respect to the main scanning direction X. With this configuration, the length of the pipe 76 of the liquid conveying section 73 can be shortened (that is, a distance of conveying liquid can be shortened). Because the length of the pipe 76 is short, air does not tend to enter liquid through the pipe 76. If air enter liquid, there is a possibility that ejection malfunction occurs.

The head lifting mechanism 35 (see FIG. 7) moves the carriage 3 up and down so that the head 10 moves between a print position and a retracted position. At the print position (see FIGS. 3 and 8A), the ejection surfaces 10*a* and the platens 44 and 45 located at the supporting-surface forming position confront each other with a space suitable for printing therebetween. At the print position, the head 10 is located at the lower end in the moving range. At the retracted position (see FIG. 8C), the ejection surfaces 10*a* and the platens 44 and 45 located at the supporting-surface forming position are spaced farther away from each other than at the print position. That is, at the retracted position, the head 10 is located at a higher position than at the print position. At the retracted position, the head 10 is located at the upper end in the moving range. A wiping position (see FIG. 8B) is located between the print position and the retracted position. At the wiping position and at the retracted position, wipers 36*a* and 36*b* (described later) can move in a space between the head 10 and the confronting member 91, 92 (described later).

The wiper unit 36 is provided for each of the heads 10. The wiper unit 36 includes the two wipers 36*a* and 36*b*, a base section 36*c*, and a wiper moving mechanism 27. The wiper 36*a* is provided to stand at the upper side of the base section 36*c* for wiping the ejection surface 10*a* (first wiping operation). The wiper 36*b* is provided to stand at the lower side of the base section 36*c* for wiping the surface of the confronting member 91, 92 (second wiping operation). The wiper moving mechanism 27 includes a pair of guides 28 (only one guide 28 is shown in FIGS. 8A-8C) and a driving motor (not shown). When the driving motor is driven, the base section 36*c* moves reciprocatingly along the guides 28. As shown in FIG. 8A, a standby position of the base section 36*c* is adjacent to the left end of the head 10. In each wiping operation, the wiper 36*a* or 36*b* wipes the surface while moving rightward in FIG. 8B or 8C. The base section 36*c* returns to the standby position in a state where the head 10 is at the retracted position and where the confronting member 91, 92 is at a third position (FIG. 6A; described later). Note that the two wiper units 36 for the respective heads 10 can be driven independently.

Returning to FIG. 3, the liquid receiving section 90 includes the two confronting members 91 and 92, a confronting-member lifting mechanism 93 (see FIG. 7), and a waste-liquid tray 94. Each of the confronting members 91 and 92 is a glass plate having a rectangular shape that is slightly larger than the ejection surface 10*a* in a plan view. The confronting members 91 and 92 are arranged between the ejection surfaces 10*a* and a paper-feed-tray mount section 19 with respect to the vertical direction Z. Further, the confronting members 91 and 92 are arranged to overlap the respective ejection surfaces 10*a* in the vertical direction Z. The confronting members 91 and 92 are provided for receiving liquid ejected from the ejection surfaces 10*a* during a purging operation described later. The confronting members 91 and 92 also constitute a cap mechanism 95 (described later) in cooperation with an annular member 96 (described later).

Figure 6C:
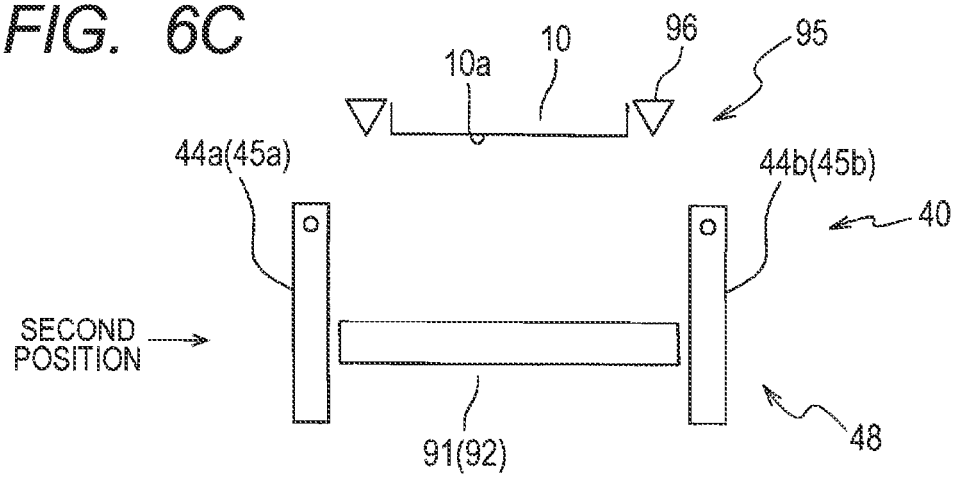

The confronting-member lifting mechanism 93 moves the confronting member 91, 92 up and down. The confronting-member lifting mechanism 93 drives the confronting member 91, 92 up and down between first and third positions. As shown in FIG. 6B, the first position is a position where the confronting member 91, 92 is the closest to the ejection surface 10*a*. A purging operation is performed in a state where the confronting member 91, 92 is located at the first position and where the head 10 is located at the print position. In a state where the confronting member 91, 92 is located at the first position and where the head 10 is located at the print position, the distance between the surface of the confronting member 91, 92 and the ejection surface 10*a* is the same as the distance between the surface of the platen 44, 45 and the ejection surface 10*a* during printing. At a second position, as shown in FIG. 6C, the distance between the surface of the confronting member 91, 92 and the ejection surface 10*a* is larger than the corresponding distance at the first position. The wiper 36*b* wipes the confronting member 91, 92 in a state where the confronting member 91, 92 is located at the second position. At the third position, as shown in FIG. 6A, the distance between the surface of the confronting member 91, 92 and the ejection surface 10*a* is larger than the corresponding distance at the second position. When the confronting member 91, 92 is located at the third position, the confronting member 91, 92 does not make contact with the wiper 36*b*. Note that the third position is also a standby position of the confronting members 91 and 92 during printing.

The waste-liquid tray 94 has a concave section 94*a*. The waste-liquid tray 94 is disposed between the confronting members 91 and 92 and the paper-feed-tray mount section 19 with respect to the vertical direction Z. The waste-liquid tray 94 is disposed to overlap the confronting members 91 and 92 and the paper-feed-tray mount section 19 in the vertical direction Z. Further, the waste-liquid tray 94 is disposed to overlap the ejection surface 10*a* in the vertical direction Z. With this configuration, the waste-liquid tray 94 receives liquid that drips from the confronting members 91 and 92 in the purging operation, and receives liquid that is wiped off from the confronting members 91 and 92 by the wiper 36*b* in the second wiping operation. In this way, the confronting members 91, 92 and the waste-liquid tray 94 can be arranged in a dead space between the heads 10 and the paper-feed-tray mount section 19. Further, because the confronting members 91, 92 and the waste-liquid tray 94 overlap the ejection surfaces 10*a*, an increase in the size of the printer 101 in a plan view can be suppressed.

The waste-liquid conveying section 97 has a pump 97*a* and a pipe 97*b* connecting the pump 97*a* with the waste-liquid tank 99. The pump 97*a* is provided at a bottom section of the waste-liquid tray 94. The controller 100 controls the pump 97*a* to discharge liquid stored in the concave section 94*a*, via the pipe 97*b*, to the waste-liquid tank 99 mounted on the waste-liquid-tank mount section 98. Note that the pump 97*a* may be omitted from the waste-liquid conveying section 97 in which case liquid stored in the concave section 94*a* is discharged, by its own weight, via the pipe 97*b* to the waste-liquid tank 99 mounted on the waste-liquid-tank mount section 98.

Figure 5B:
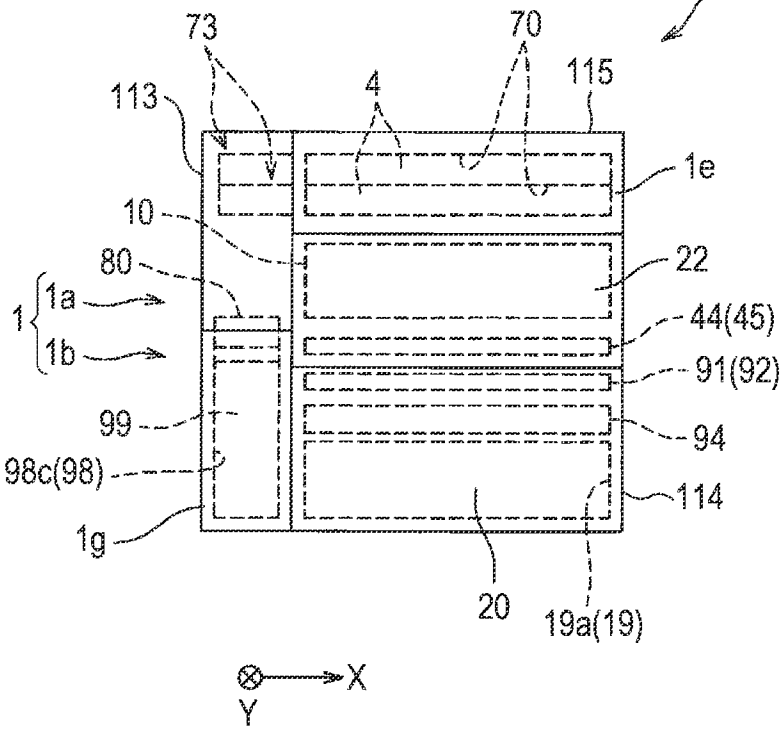
FIG. 5B is a schematic front view of the printer.
Figure 5A:
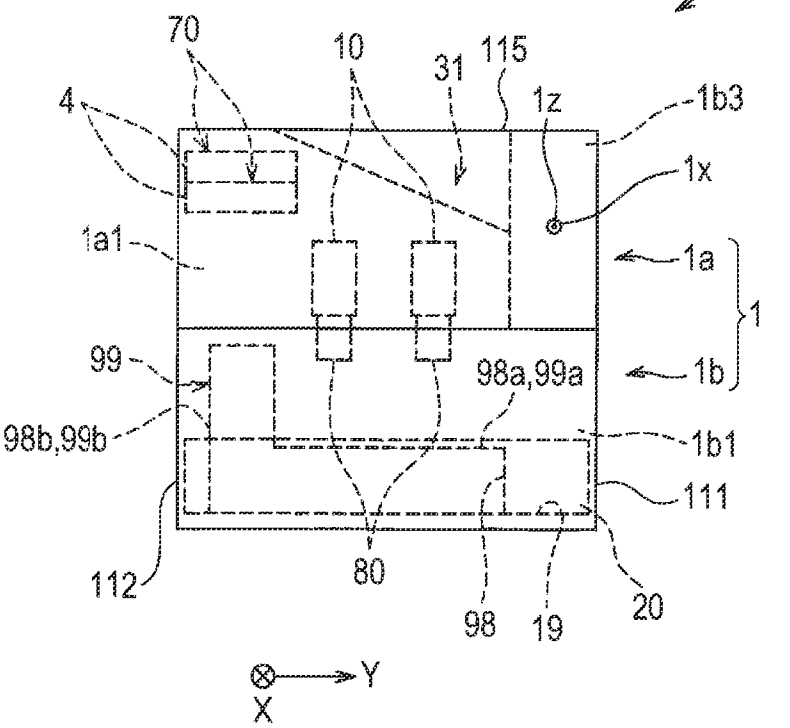
FIG. 5A is a schematic side view of the printer.
Figure 5C:
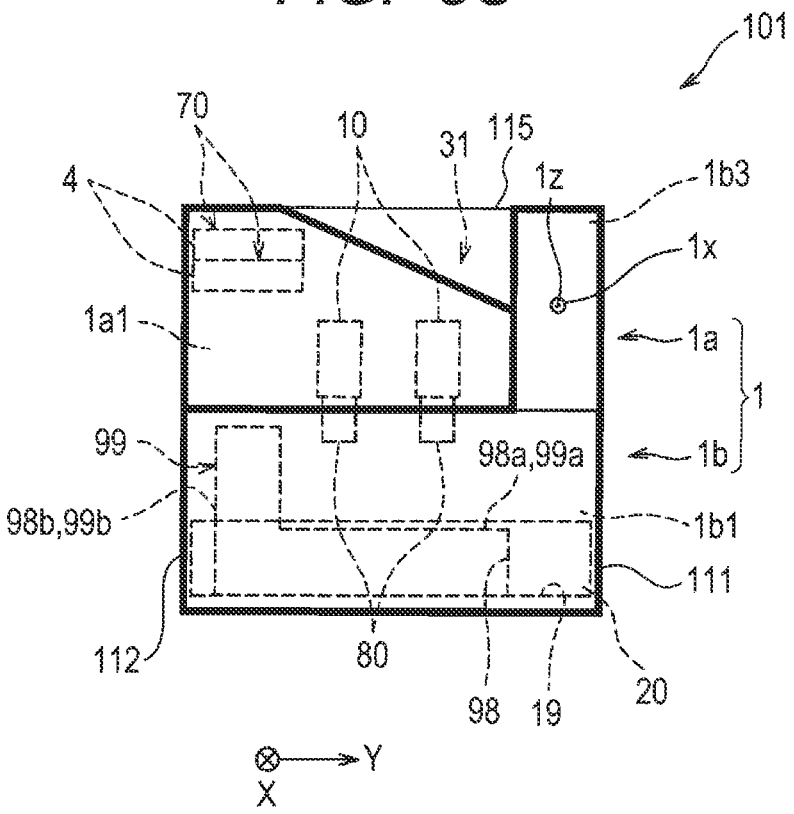
FIG. 5C is a schematic side view of the printer for particularly showing frames of the upper and lower casings.

As shown in FIGS. 3, 4, and 5B, the waste-liquid-tank mount section 98 is disposed at a position below the liquid conveying section 73 and the subsidiary tanks 80. The waste-liquid-tank mount section 98 is for defining a space to which the waste-liquid tank 99 is mounted. A mount opening 98*c* (third opening) of the waste-liquid-tank mount section 98 is formed in the front surface 112 of the lower casing 1*b*. As shown in FIG. 9, the mount opening 98*c* is formed at a lower position on the front surface 112, the position being close to the left surface 113. The mount opening 98*c* has generally a rectangular shape that is elongated in the vertical direction Z. The mount opening 98*c* is arranged at a position lateral to the mount opening 19*a*. The waste-liquid-tank mount section 98 has a space extending from the mount opening 98*c*, and from the front surface 112 toward the rear surface 111. This space has a size and shape capable of accommodating the waste-liquid tank 99. A door 1*g* (see FIG. 1) is provided at the lower casing 1*b* for opening/closing the mount opening 98*c*. Note that the door 1*g* is omitted in FIG. 9 for simplicity. The door 1*g* is a plate-shaped member that is pivotally supported by the lower casing 1*b*. By pivotally moving the door 1*g* in the direction of the arrow in FIG. 1, the mount opening 98*c* is exposed. The waste-liquid tank 99 is inserted into and removed from the waste-liquid-tank mount section 98 through the mount opening 98*c*. The waste-liquid tank 99 is mounted on the waste-liquid-tank mount section 98 by being inserted into the mount opening 98*c*. Further, the waste-liquid tank 99 can be replaced by inserting and removing the waste-liquid tank 99. The inserting and removing direction of the waste-liquid tank 99 is the same as the inserting and removing direction of the cartridges 4.

The waste-liquid-tank mount section 98 has a horizontal section 98*a* and a vertical section 98*b*, and has an L-shape as viewed from the main scanning direction X. The horizontal section 98*a* is an elongated section that extends in the sub-scanning direction Y. The vertical section 98*b* is formed to protrude upward from the front surface 112 side of the horizontal section 98*a*. With respect to the vertical direction Z, the vertical section 98*b* overlaps the liquid conveying section 73, and the horizontal section 98*a* overlaps the subsidiary tanks 80. Further, the vertical section 98*b* overlaps the subsidiary tanks 80 in the sub-scanning direction Y. The subsidiary tanks 80 are arranged at positions overlapping the waste-liquid-tank mount section 98 in this way. With this configuration, the subsidiary tanks 80 can be arranged in a dead space that is located above the waste-liquid-tank mount section 98. Further, an increase in the size of the printer 101 in a plan view can be suppressed, compared with a case in which the waste-liquid-tank mount section 98 and the subsidiary tanks 80 are arranged at positions that do not overlap each other in the vertical direction Z and in the sub-scanning direction Y. In addition, as shown in FIGS. 3 and 5A, the waste-liquid-tank mount section 98 overlap the paper-feed-tray mount section 19 described later in the main scanning direction X, and the waste-liquid-tank mount section 98 is disposed at a position closer to the left surface 113 than the paper-feed-tray mount section 19 is. With this configuration, an increase in the height of the printer 101 can be suppressed.

The waste-liquid tank 99 has a horizontal section 99*a* and a vertical section 99*b*, and has an L-shape as viewed from the main scanning direction X, like the waste-liquid-tank mount section 98. The horizontal section 99*a* is a part that is disposed at the horizontal section 98*a* when the waste-liquid tank 99 is mounted on the waste-liquid-tank mount section 98. The horizontal section 99*a* is elongated in the sub-scanning direction Y. The vertical section 99*b* is formed to protrude upward from the end of the horizontal section 99*a* at the front surface 112 side. The vertical section 99*b* is a part that is disposed at the vertical section 98*b* when the waste-liquid tank 99 is mounted on the waste-liquid-tank mount section 98. The waste-liquid tank 99 is connected with the pipe 97*b* of the waste-liquid conveying section 97 via, a connection mechanism (not shown) when the waste-liquid tank 99 is mounted on the waste-liquid-tank mount section 98. Note that an air vent port is provided at a top part of the vertical section 99*b* for venting air when liquid flows into the waste-liquid tank 99 and for venting liquid vapor to reduce the amount of liquid in the waste-liquid tank 99.

As modifications, the waste-liquid tray 94, the waste-liquid conveying section 97, and the waste-liquid tank 99 may be provided separately for each head 10. Further, the inside of the waste-liquid tray 94 and the waste-liquid tank 99 may be divided. With this configuration, pretreatment liquid and ink are not mixed easily, and condensation can be suppressed.

As shown in FIG. 3, the first paper feeding section 1*c* is disposed below the paper discharging section 31, the head unit 9, and the platens 44 and 45, and overlaps these components in the vertical direction Z. Hence, the paths R1 through R3 are formed in a reversed S-shape as described above, and the size of the printer 101 in a plan view is made small. As a result, the footprint of the printer 101 can be made small. The first paper feeding section 1*c* has the paper feed tray 20, a paper feed roller 21, and the paper-feed-tray mount section 19 on which the paper feed tray 20 is mounted.

As shown in FIGS. 3, 5A, and 5B, the paper-feed-tray mount section 19 defines a space to which the paper feed tray 20 is mounted, and extends in the sub-scanning direction Y. The mount opening 19*a* (first opening) of the paper-feed-tray mount section 19 is formed in the front surface 112 of the lower casing 1*b*. As shown in FIG. 9, the mount opening 19*a* is formed at a lower position on the front surface 112. The mount opening 19*a* and the mount opening 71 are arranged at positions that overlap each other in the vertical direction Z. The mount opening 19*a* has generally a rectangular shape that is elongated in the main scanning direction X. The paper-feed-tray mount section 19 has a space having generally a rectangular-parallelepiped shape extending from the mount opening 19*a*, and from the front surface 112 toward the rear surface 111. This space has a size and shape capable of accommodating the paper feed tray 20. As shown in FIG. 3, the paper feed tray 20 is inserted into or removed from the paper-feed-tray mount section 19 through the mount opening 19*a*. The paper feed tray 20 is mounted on the paper-feed-tray mount section 19 by being inserted into the mount opening 19*a*. Note that, in a state where the paper feed tray 20 is mounted on the paper-feed-tray mount section 19, the surface of the paper feed tray 20 at the front surface 112 side is aligned to be flush with the front surface 112 of the apparatus casing 1. The inserting and removing direction of the paper feed tray 20 is the same as the inserting and removing direction of the waste-liquid tank 99 and the cartridges 4. The paper feed tray 20 is a box opened upward and can accommodate paper P. The controller 100 controls the paper feed roller 21 to rotate and send out paper P that is located at the uppermost position in the paper feed tray 20.

The second paper feeding section 1*d* has the manual-feed tray 22 (the door 22) and a paper feed roller 23 (feeding mechanism), and is configured to feed paper to a middle part of the path R1. The manual-feed tray 22 that can be opened/closed is provided at the front surface 112 of the apparatus casing 1. The manual-feed tray 22 is a plate-shaped member that is pivotally supported by the lower casing 1*b*. The manual-feed tray 22 is pivotable between: a close position at which the manual-feed tray 22 closes an opening 1*ab* (FIG. 3) formed in the front surface 112 of the apparatus casing 1 (the position shown in FIG. 1); and an open position at which the manual-feed tray 22 opens the opening 1*ab* (the position shown in FIG. 2). Normally (when the second paper feeding section 1*d* is not used), the manual-feed tray 22 is located at the close position so as to cover the opening 1*ab*. That is, when the manual-feed tray 22 closes the opening 1*ab*, the manual-feed tray 22 constitutes a part of the front surface 112 of the apparatus casing 1. When the manual-feed tray 22 closing the opening 1*ab* is pivotally moved to the open position as shown in FIG. 2, the second paper feeding section 1*d* becomes a usable state. Paper P in predetermined sizes is placed on the manual-feed tray 22 when the manual-feed tray 22 is located at the open position, and the controller 100 controls the paper feed roller 23 to rotate. With this operation, paper P on the manual-feed tray 22 is conveyed from the path R4 via the path R1 to the path R2. Because the manual-feed tray 22 is also provided at the front surface 112 of the apparatus casing 1 as described above, an operation of placing paper P on the manual-feed tray 22 can also be accessed from the front surface 112. That is, "front access" becomes possible.

Next, the controller 100 will be described. The controller 100 includes a CPU (Central Processing Unit) serving as an arithmetic processing unit, as well as a ROM (Read Only Memory), a RAM (Random Access Memory: including a non-volatile RAM), an ASIC (Application Specific Integrated Circuit), an I/F (Interface), and I/O (Input/Output Port), and the like. The ROM stores programs executed by the CPU, various fixed data, and the like. The RAM temporarily stores data (image data etc.) that are necessary when programs are executed. The ASIC performs rewriting, rearrangement, etc of image data (for example, signal processing and image processing). The I/F performs transmission and reception of data with an external device. The I/O performs input/output of detection signals of various sensors.

The controller 100 controls operations of each section of the printer 101 and governs overall operations of the printer 101. The controller 100 controls a recording operation based on a print command (image data etc.) supplied from an external device (a PC etc. connected with the printer 101). Upon receiving the print command, the controller 100 drives the first paper feeding section 1*c* (or the second paper feeding section 1*d*) and the roller pairs 51 through 57. Paper P sent out from the first paper feeding section 1*c* is conveyed along the paths R1 and R2. Paper P sent out from the second paper feeding section 1*d* is conveyed from the path R4 via the path R1 to the path R2. When paper P sequentially passes positions directly below the heads 10 (recording positions) while being supported on the platens 44 and 45, the controller 100 controls each head 10 to drive and eject liquid from ejection ports of the ejection surface 10*a* toward paper P. In this way, an image is formed on paper P. After that, paper P is conveyed along the path R3 and is discharged onto the paper discharging section 31.

The controller 100 controls maintenance operations such as recovery of liquid ejecting characteristics of the heads 10. The maintenance operations include a purging operation, a first wiping operation for the ejection surface 10*a*, a second wiping operation for the confronting member 91, 92, and the like.

Here, an example of the maintenance operation will be described with reference to FIGS. 8A through 8C.

Upon receiving a maintenance signal, the controller 100 controls the purging operation. The controller 100 controls the supporting mechanism 48 such that the platen 44, 45 (the divided platens 44*a*, 44*b*, 45*a*, 45*b*) takes the open position and, subsequently, as shown in FIG. 8A, controls the confronting-member lifting mechanism 93 such that confronting member 91, 92 takes the first position. After that, the controller 100 controls the pump 82 to supply liquid to the head 10 with pressure (the purging operation). At the purging operation of the present embodiment, a predetermined amount of liquid in the cartridge 4 is forcefully sent to the head 10 so that liquid is discharged from the ejection ports.

Next, the first wiping operation is performed. At this time, the controller 100 controls the head lifting mechanism 35 such that the head 10 takes the wiping position, and controls the confronting-member lifting mechanism 93 such that the confronting member 91, 92 takes the third position. After that, as shown in FIG. 8B, the controller 100 controls the wiper unit 36 (the wiper moving mechanism 27) to wipe the ejection surface 10*a* with the wiper 36*a* (the first wiping operation). After the first wiping operation, the controller 100 controls the head lifting mechanism 35 such that the head 10 takes the retracted position and, subsequently, controls the wiper unit 36 to return the base section 36*c* (the wipers 36*a* and 36*b*) to the standby position.

Next, the second wiping operation is performed. The controller 100 controls the confronting-member lifting mechanism 93 such that the confronting member 91, 92 takes the second position. After that, as shown in FIG. 8C, the controller 100 controls the wiper unit 36 (the wiper moving mechanism 27) to wipe the surface of the confronting member 91, 92 with the wiper 36*b* (the second wiping operation). After the second wiping operation, the controller 100 controls the confronting-member lifting mechanism 93 such that the confronting member 91, 92 takes the third position and, subsequently, controls the wiper unit 36 to return the base section 36*c* (the wipers 36*a* and 36*b*) to the standby position. Further, at this time, the controller 100 drives the pump 97*a* of the waste-liquid conveying section 97 to discharge, to the waste-liquid tank 99, liquid stored in the waste-liquid tray 94 as a result of the purging operation and the first and second wiping operations.

Next, the controller 100 controls the head lifting mechanism 35 such that the head 10 takes the print position. After that, the cap mechanism 95 seals a space facing the ejection surface 10*a* from the external space, so that the head 10 becomes a standby state. Then, the maintenance operation ends.

The cap mechanism 95 includes the confronting member 91, 92 and the annular member 96 (schematically shown in FIGS. 6A through 6C). The annular member 96 is provided at the periphery of each head 10 and is configured to be moved up and down by a moving mechanism (not shown). In order to seal the space facing the ejection surface 10*a* from the external space, the confronting member 91, 92 is moved to the first position, and the annular member 96 is moved down so as to seal the space facing the ejection surface 10*a* in cooperation with the confronting member 91, 92.

Next, the structure of the paper discharge tray 200 and an operation in a state where the paper discharge tray 200 is additionally mounted on the printer 101 will be described below while referring to FIG. 10.

The paper discharge tray 200 includes a paper discharge section 201 (second discharge section), a conveying mechanism 240, a connection terminal (not shown), and a casing 200*a*. The paper discharge section 201 supports discharged paper P. The conveying mechanism 240 has a conveying motor and components defining a path R6 described below. The connection terminal electrically connects the conveying motor of the conveying mechanism 240 with the controller 100. The casing 200*a* supports these components. The path R6 is a path leading from the path R5 to the paper discharge section 201, and is defined by guides 202 and 203 and roller pairs 204 and 205.

A protruding section 210 protruding downward is provided at the casing 200*a* of the paper discharge tray 200. The protruding section 210 is provided with four (4) L-shaped engaging sections 211. Two attachment holes 1*b*5 are formed in each of the protruding sections 1*b*3 of the frames 1*b*1 of the lower casing 1*b*. By inserting the engaging sections 211 into the respective attachment holes 1*b*5, the paper discharge tray 200 is attached to the lower casing 1*b* of the printer 101. At this time, the connection terminal is electrically connected with a terminal (not shown) connected with the controller 100 of the printer 101. With this configuration, the controller 100 can control the conveying motor of the conveying mechanism 240. In addition, the path R5 and the path R6 are connected at this time. The paper discharge section 201 is located above the paper discharging section 31, and overlaps the paper discharging section 31 in the vertical direction Z. The paper discharge section 201 projects from the rear surface 111 side toward the front surface 112 side. With this configuration, although the paper discharge section 201 is disposed above the paper discharging section 31, an operation of taking paper P from the paper discharging section 31 can be accessed from the front surface 112 side. That is, "front access" becomes possible. Further, like the supporting surface 31*a*, a supporting surface 201*a* for supporting paper P discharged to the paper discharge section 201 is also slanted such that the end at the front surface 112 side is located at a higher position than the end at the rear surface 111 side. With this configuration, paper P discharged to the paper discharge section 201 can be taken out from the front surface 112 side most easily. Hence, an operation of taking paper P from the paper discharge section 201 can be accessed from the front surface 112 side. That is, "front access" becomes possible.

When paper P is discharged to the paper discharge section 201 of the paper discharge tray 200 under controls by the controller 100, the controller 100 controls the conveying motor of the conveying mechanism 240 to drive the roller pairs 204 and 205. At this time, the controller 100 controls the switching mechanism 69 such that the swing member 69*a* is disposed at the second position. In this way, paper P conveyed from the path R3 to the path R5 is discharged to the paper discharge section 201 via the path R6.

Figure 10:
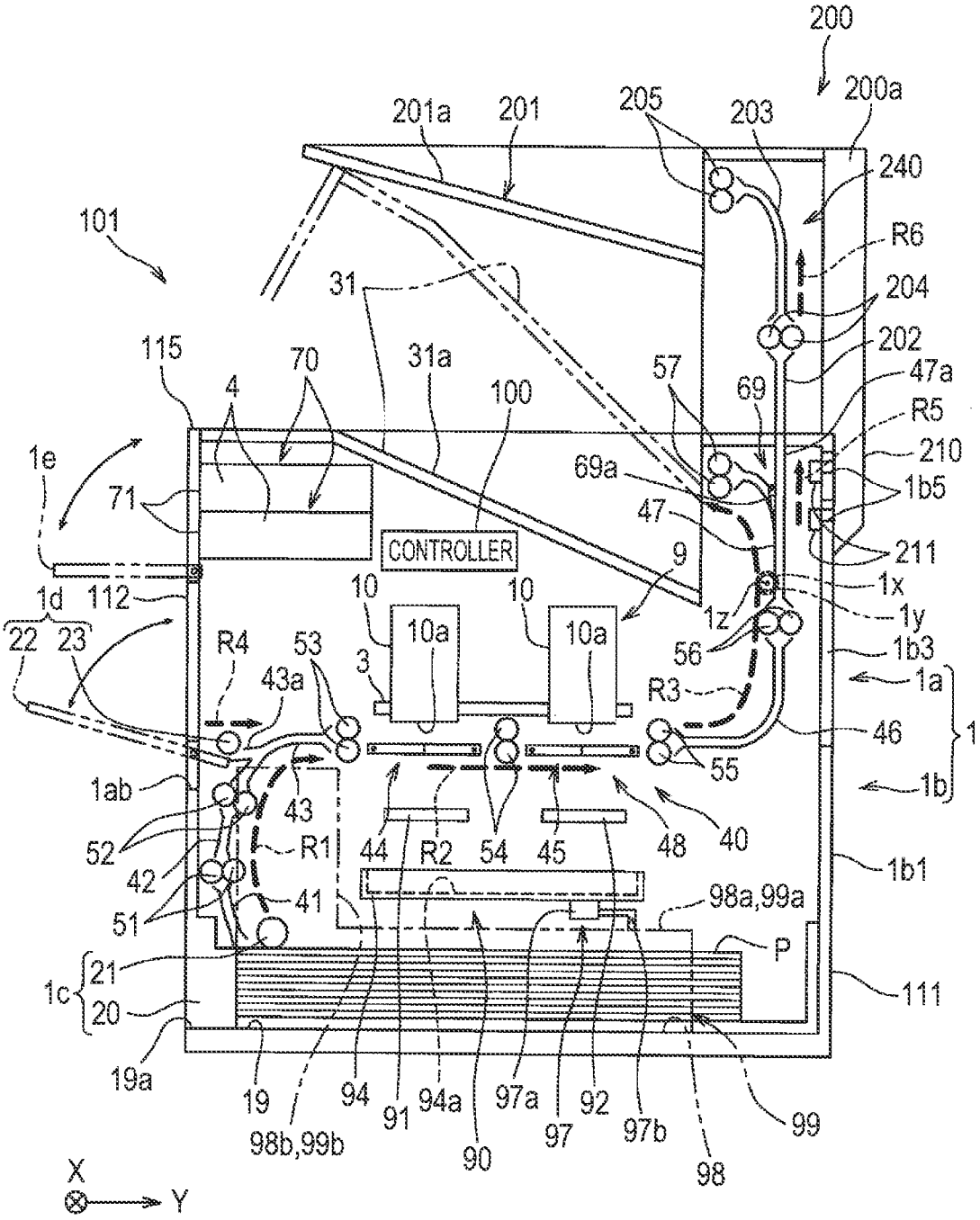
FIG. 10 is a schematic side view showing the interior of the printer in a state where an additional paper discharge tray is attached.

As indicated by the double-dot chain lines in FIG. 10, the paper discharge section 201 of the paper discharge tray 200 abuts the front-upper corner (the left-upper corner in FIG. 10) of the upper casing 1*a* when the upper casing 1*a* is pivotally moved to the spaced position. With this configuration, the paper discharge section 201 functions as a stopper for restricting pivotal movement of the upper casing 1*a* when the upper casing 1*a* is moved to the spaced position. This prevents the upper casing 1*a* from opening excessively widely. Because the upper casing 1*a* is prevented from opening excessively widely, paper P remaining on the paper discharging section 31 does not fall easily.

As described above, according to the printer 101 of the present embodiment, portions accessed by a user during a jam process etc. is located on the front surface 112 side of the apparatus casing 1. In other words, the upper casing 1*a* is farthest away from the lower casing 1*b* at the end of the front surface 112 side when the upper casing 1*a* is pivotally moved to the spaced position. And, the mount openings 19*a*, 71, and 98*c* of the paper feed tray 20, the cartridge 4, and the waste-liquid tank 99, respectively, are formed in the front surface 112 of the apparatus casing 1. Hence, inserting and removing operations of the paper feed tray 20, the cartridge 4, and the waste-liquid tank 99, and maintenance operations such as a jam process can be accessed from the front surface 112. As a result, multiple operations can be accessed from the front surface 112. That is, "front access" becomes possible. In other words, for multiple operations, portions accessed by a user are gathered on the front surface 112.

While the invention has been described in detail with reference to the above aspects thereof, it would be apparent to those skilled in the art that various changes and modifications may be made therein without departing from the scope of the claims.

For example, it is not necessary that the supporting surfaces 31*a* and 201*a* of the paper discharging sections 31 and 201 be slanted.

Further, it is not necessary that the cartridge mount section 70 overlap the paper discharging section 31 in the vertical direction Z. Further, the paper-feed-tray mount section 19 and the waste-liquid-tank mount section 98 may overlap each other in the vertical direction Z, not in the main scanning direction X. Further, it is not necessary that the waste-liquid-tank mount section 98 overlap the subsidiary tanks 80 in the vertical direction Z.

Further, it is not necessary that the paper discharge tray 200 can be added. Also, a manual feed tray may be provided at a side surface other than the front surface 112 of the apparatus casing 1.

Further, the liquid conveying section 73 may have any configuration as long as liquid can be conveyed from the cartridges 4 to the subsidiary tanks 80. The waste-liquid conveying section 97 also may have any configuration as long as liquid can be conveyed from the liquid receiving section 90 to the waste-liquid tank 99. It is not necessary that the paths R1 through R3 be formed in an S-shape, and the paths R1 through R3 may be formed in a linear shape extending in generally a horizontal direction, for example.

Note that, in the present embodiment, the front surface is defined as a surface in which the mount openings 19*a*, 71, and 98*c* of the paper feed tray 20, the cartridge 4, and the waste-liquid tank 99, respectively, are formed. However, the surface in which the mount openings 19*a*, 71, and 98*c* are formed need not be the front surface. For example, the surface in which the mount openings 19*a*, 71, and 98*c* are formed may be the rear surface, the right surface, or the left surface of the apparatus casing 1.

In the above-described embodiment, the platens 44 and 45 are described as an example of the supporting section that supports a recording medium. However, another configuration such as a conveying belt may be adopted as the supporting section.

The invention can be applied not only to a monochromatic printer but also to a color printer. The invention is not limited to a printer, but can be applied to a facsimile apparatus, a copier, and the like. The heads may eject any liquid other than ink or pretreatment liquid. The number of heads included in the liquid ejecting device may be one or greater than two. A recording medium is not limited to paper P, but may be any medium on which recording can be performed.

What is claimed is:

1. A liquid ejecting device comprising:

an apparatus frame comprising a first frame and a second frame, the apparatus frame having a side surface;

a liquid ejecting head having an ejection surface that is formed with ejection ports for ejecting liquid, the liquid ejecting head being accommodated in the first frame and extending in a first direction; and a supporting section configured to support a recording medium, the supporting section being accommodated in the second frame, wherein the first frame is movable relative to the second frame, movement of the first frame allowing the first frame to take a first position at which the ejection surface confronts the supporting section and a second position at which the ejection surface is farther away from the supporting section than at the first position;

wherein the side surface is formed with: a first opening through which a medium tray configured to accommodate a recording medium is inserted or removed; and a second opening through which a first tank configured to store liquid supplied to the liquid ejecting head is inserted or removed; and wherein a wiper mechanism is provided in the second frame, the wiper mechanism comprising a wiper member configured to wipe the ejection surface and a wiper moving mechanism configured to move the wiper member, wherein the first frame comprises a first-tank mount section formed with a space in which the first tank is mounted, the space being in communication with the second opening, wherein a second tank is provided at the first frame, the second tank being configured to temporarily store liquid conveyed from the first tank mounted on the first-tank mount section and to supply the liquid ejecting head with the liquid, and wherein the first-tank mount section is disposed at a higher position than the second tank.

2. The liquid ejecting device according to claim 1, wherein the wiper moving mechanism is configured to move the wiper member between: a wiping position at which the wiper member confronts and contacts the ejection surface; and a standby position at which the wiper member does not confront the ejection surface.

3. The liquid ejecting device according to claim 1, wherein the medium tray and the first tank are configured to be inserted or removed in an insertion direction perpendicular to the side surface; and wherein the wiper member is configured to move in a direction that is perpendicular to the insertion direction and that is parallel with the side surface.

4. The liquid ejecting device according to claim 1, wherein a receiving section and a waste-liquid tank are provided in the second frame, the receiving section having a receiving surface configured to receive liquid ejected from the liquid ejecting head, the waste-liquid tank being configured to store liquid received by the receiving surface.

5. The liquid ejecting device according to claim 4, wherein the receiving section is disposed at a position in confrontation with the ejection surface of the liquid ejecting head.

6. The liquid ejecting device according to claim 4, wherein the receiving section extends in the first direction.

7. The liquid ejecting device according to claim 4, wherein a length of the receiving section in the first direction is greater than a length of the ejection surface in the first direction.

8. The liquid ejecting device according to claim 4, wherein a length of the receiving section in a second direction is greater than a length of the ejection surface in the second direction, the second direction being a direction in parallel with the ejection surface and perpendicular to the first direction.

9. The liquid ejecting device according to claim 4, wherein the receiving section is disposed at a lower position than the supporting section during recording.

10. The liquid ejecting device according to claim 4, wherein the second frame comprises a medium-tray mount section formed with a space in which the medium tray is mounted, the space being in communication with the first opening; and wherein the medium-tray mount section and the waste-liquid tank at least partially overlap each other in a horizontal direction.

11. The liquid ejecting device according to claim 4, wherein the side surface is formed with a third opening through which the waste-liquid tank is inserted or removed.

12. The liquid ejecting device according to claim 1, wherein the liquid ejecting head and the first tank are elongated in the first direction in a state where the first tank is mounted on the first-tank mount section.

13. The liquid ejecting device according to claim 12, wherein the first-tank mount section is disposed at a higher position than the liquid ejecting head.

14. The liquid ejecting device according to claim 12, wherein the apparatus frame has a pair of first-direction intersecting surfaces at both ends of the liquid ejecting device in the first direction, each of the pair of first-direction intersecting surfaces intersecting with the first direction;

wherein a connection of the first-tank mount section with the first tank is disposed at a position closer to one of the pair of first-direction intersecting surfaces than to an other one of the pair of first-direction intersecting surfaces; and wherein the second tank is disposed at a position closer to the one of the pair of first-direction intersecting surfaces than to the other one of the pair of first-direction intersecting surfaces.

15. The liquid ejecting device according to claim 1, wherein the apparatus frame comprises a discharge section that is configured to receive a recording medium on which an image has been formed by the liquid ejecting head.

16. The liquid ejecting device according to claim 15, wherein the discharge section is disposed at a higher position than the liquid ejecting head.

17. The liquid ejecting device according to claim 15, wherein the second frame comprises a medium-tray mount section formed with a space in which the medium tray is mounted, the space being in communication with the first opening; and wherein the medium-tray mount section and the discharge section are arranged at positions at least partially overlapping each other in a vertical direction.

18. The liquid ejecting device according to claim 17, wherein a conveying mechanism is provided in the second frame, the conveying mechanism being configured to convey the recording medium from the medium tray to the discharge section in a state where the medium tray is mounted on the medium-tray mount section.

19. The liquid ejecting device according to claim 18, wherein the conveying mechanism defines a conveying path along which the conveying mechanism is configured to convey the recording medium upward at a side of the liquid ejecting head from a recording position between the ejection surface and the supporting section, and to subsequently convey the recording medium in an opposite direction from a conveying direction of the recording medium at the recording position.

* * * * *